United States Patent [19]

Socey

[11] Patent Number: 4,827,535

[45] Date of Patent: May 9, 1989

[54] HAND COVERING HAVING COOPERATING FASTENERS ON THE FINGER AND THUMB PORTIONS THEREOF

[75] Inventor: Thomas C. Socey, Wheaton, Md.

[73] Assignee: Robert H. Socey, Washington, D.C.; a part interest

[21] Appl. No.: 228,728

[22] Filed: Aug. 5, 1988

[51] Int. Cl.[4] ..... A41D 19/00; A41D 19/01

[52] U.S. Cl. ..... 2/161 A; 2/160; 2/DIG. 6

[58] Field of Search ..... 2/17, 160, 161 A, DIG. 6

[56] References Cited

U.S. PATENT DOCUMENTS

| | | | |
|---|---|---|---|
| 1,149,139 | 8/1915 | Heagle | 2/161 A X |
| 3,348,238 | 10/1967 | Hydock | 2/161 A |
| 3,559,212 | 2/1971 | Skovron | 2/161 A |
| 4,587,673 | 5/1986 | Boliard | 2/161 A |
| 4,665,565 | 5/1987 | Odom | 2/161 A |
| 4,691,387 | 9/1987 | Lopez | 2/160 X |
| 4,793,005 | 12/1988 | Hetzel, Jr. | 2/161 A |
| 4,796,306 | 1/1989 | Mitchell | 2/160 |

OTHER PUBLICATIONS

Velcro Product News, Jun. 1978, PN No. 46, p. 2.

*Primary Examiner*—Werner H. Schroeder
*Assistant Examiner*—Sara M. Current
*Attorney, Agent, or Firm*—Brady, O'Boyle & Gates

[57] ABSTRACT

A hand covering such as a mitten or glove employing a VELCRO® fastener wherein the hook portion of the fastener is secured to the thumb portion and the loop portion of the fastener extends across the back of the finger portion and configured to correspond to the area between the finger tips and the next proximate finger joints of the wearer, the loop portion of the fastener also extending slightly over the top edge on the front of the finger portion, to thereby facilitate the gripping of various objects having different diameters.

15 Claims, 2 Drawing Sheets

HAND COVERING HAVING COOPERATING FASTENERS ON THE FINGER AND THUMB PORTIONS THEREOF

BACKGROUND OF THE INVENTION

Gloves have been provided to facilitate the gripping of various objects such as vehicle steering wheels, golf clubs, baseball bats, handle bars, water ski handles, weight-lifting bars, and the like. Initially, the gripping enhancement of these gloves was provided by the inherent friction between the glove material and the object being gripped. With the arrival of hook and loop fasteners, known as VELCRO®, the gripping action of the glove has been improved by providing the cooperating loop and hook portions selectively on the glove and object being gripped as disclosed in U.S. Pat. Nos. 4,665,565, dated May 9, 1987 and 4,691,387, dated Sept. 8, 1987.

U.S. Pat. No. 4,665,565 also discloses the use of cooperating loops and hooks on portions of the glove palm and fingers to facilitate gripping a golf club.

While the gloves disclosed in the prior art have been satisfactory for their intended purpose, they have been limited somewhat in their acceptance in that where the cooperating loop and hook portions are provided on the glove and object being gripped, the use of the glove was restricted for use with an object also having a VELCRO® portion. That is, a glove having the loop portion of the VELCRO® fastener was restricted for use with a bat or golf club provided with a cooperating hook portion of the fastener.

In the case where the cooperating loop and hook portions are provided on portions of the glove palm and fingers, the use of the glove is limited to objects having a small diameter such as a golf club, whereby the fastener portion on the finger portions engages the fastener portion on the palm portion. This type of glove cannot be used on objects having a relatively larger diameter, such as a weight-lifting bar, because the ends of the glove fingers would not meet with the palm portion of the glove.

After considerable research and experimentation, the glove and mitten of the present invention has been devised to facilitate gripping various objects having diameters ranging from very small to relatively large. The glove and mitt of the present invention utilizes VELCRO® wherein the hook portion of the fastener is secured to the surface of the thumb portion facing the index finger. The loop portion of the fastener extends across the back of the mitt and slightly over the front top edge thereof. Similarly, when using a glove, the loop portion extends across the back of each finger of the glove and slightly over the front edge thereof. The extent of the loop portions on the back of the mitt and glove is configured to correspond to the area between the user's finger tips and the next proximate finger joints.

By this construction and arrangement, when a rod or shaft is gripped, the mitt or glove is wrapped around the shaft so that the loop portion on the back of the mitt or glove faces and engages the hook portion on the thumb portion on the mitt or glove. The particular area in which the hooks and loops become engaged will depend upon the diameter of the shaft being gripped. For relatively large diameter shafts, the hook portion of the fastener will engage the loop portion of the fastener near the finger tips of the glove or mitt. For relatively small diameter shafts, the hook portion of the fastener will engage the loop portion in the vicinity of the finger joints proximate to the finger tips.

DESCRIPTION OF THE PREFERRED EMBODIMENT

Figure 1:
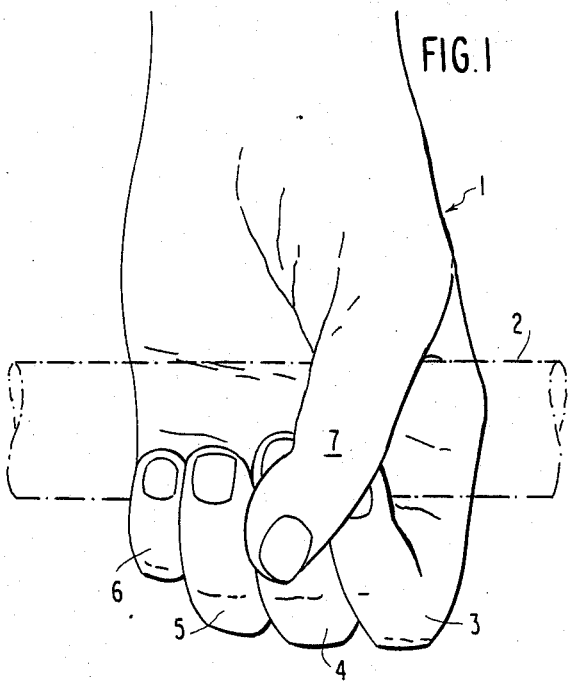
FIG. 1 is a view of a person s left hand, illustrating the normal position of the fingers and thumb when gripping a shaft.

Referring to the drawings and more particularly to FIG. 1, there is illustrated a person's left hand 1 gripping a bar or shaft 2, wherein the index finger 3, middle finger 4, ring finger 5, and little finger 6 are wrapped around the shaft 2 and the thumb 7 extends in an overlapping relationship with the distal portions of the index and middle fingers.

Figure 2:
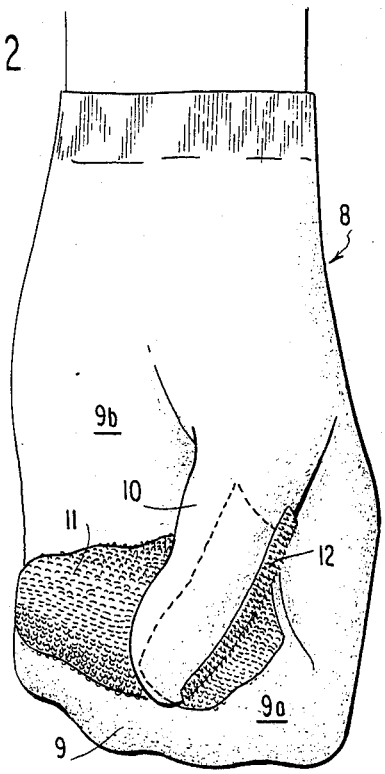
FIG. 2 is a view of a mitt of the present invention illustrating the relative positions of the finger and thumb portions when the user's hand is in the gripping position as shown in FIG. 1.
Figure 3:
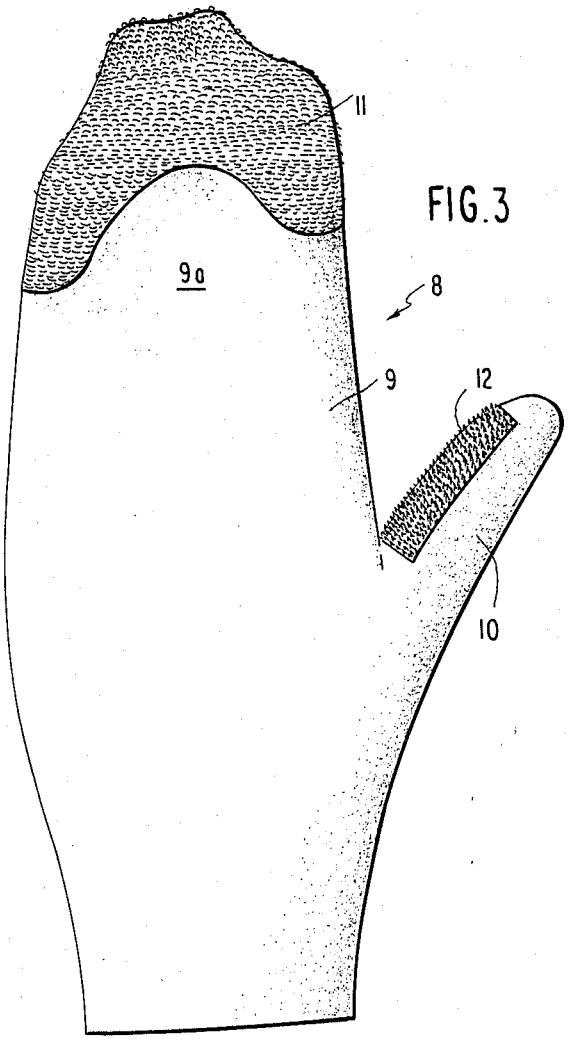
FIG. 3 is a rear elevational view of the mitt of the present invention showing the loop portion of the fastener on the back surface of the mitt, and the hook portion on the thumb of the mitt.
Figure 4:
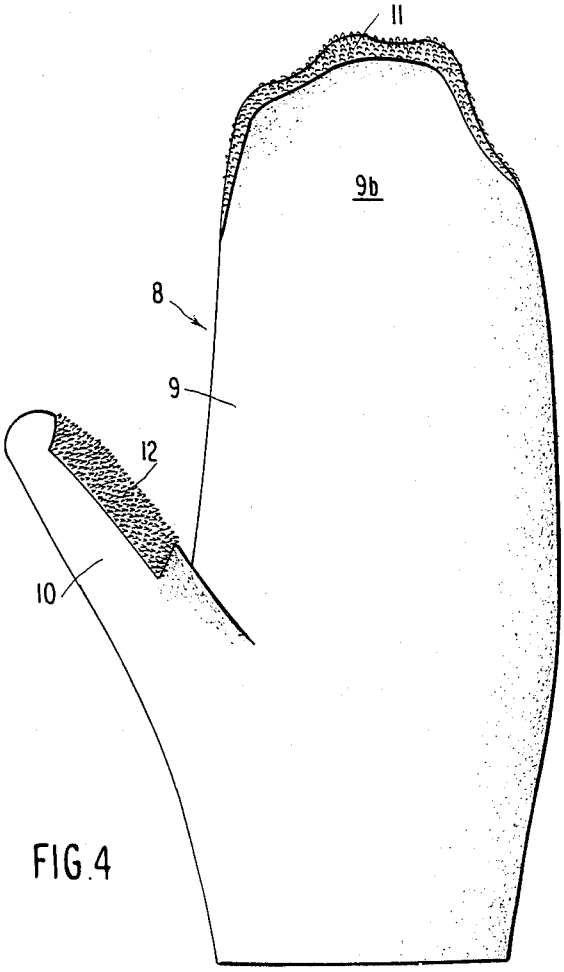
FIG. 4 is a front elevational view of the mitt illustrated in FIG. 3 showing the hook portion of the fastener extending slightly over the front edge of the finger tip portion of the mitt.

In order to facilitate the gripping of the shaft 2, the mitt 8 of the present invention has been devised as shown in FIGS. 2 to 4, and comprises a finger portion 9 and a thumb portion 10. The mitt is provided with a VELCRO® fastener wherein the back surface **9*a* of the finger portion 9 is provided with the looped portion 11 of the fastener adapted to cooperate with the hooked portion 12 of the fastener provided on the mitt thumb The loop portion 11 extends across the back of the mitt, as shown in FIG. 3, and slightly over the top edge of the front or palm side 9*b* of the mitt as shown in FIG. 4. The extent of the loop portion 11 on the back 9*a* or face of the mitt 8 is configured to correspond to the area between the finger tips of the wearer and the next proximate finger joints, and the hook portion 12** of the fastener is secured to the surface of the thumb portion facing the index finger.

Figure 5:
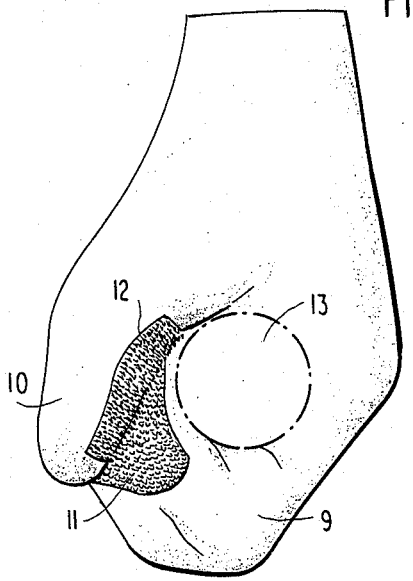
FIG. 5 is a side elevational view of the mitt of the present invention showing the relative position of the finger and thumb portions when gripping a shaft of relatively small diameter.

When using the mitt 8 of the present invention, as shown in FIG. 5, if a shaft or rod 13 of relatively small diameter is being gripped, the finger portion 9 of the mitt is wrapped around the shaft 13 to such an extent that the hook portion 12 of the fastener on the thumb portion 10 engages a considerable area of the loop portion 11 on the finger portion of the mitt.

Figure 6:
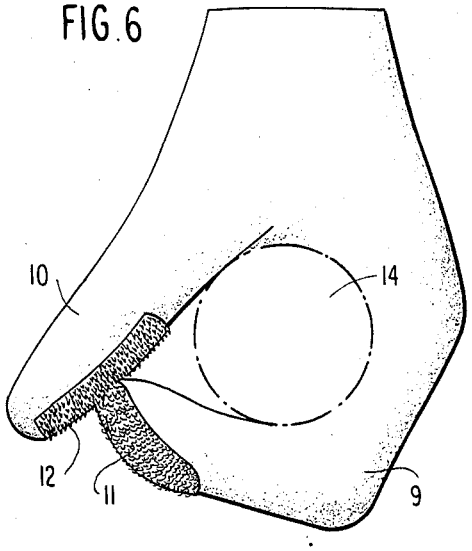
FIG. 6 is a side elevational view of the mitt of the present invention showing the relative positions of the finger and thumb portions when gripping a shaft of relatively large diameter.

If a comparatively large diameter shaft 14, as shown in FIG. 6, is being gripped, the finger portion 9 of the mitt and thumb portion 10 are unable to be wrapped around the shaft 14 and in an overlapping relationship to the extent shown in FIG. 5; however, the hook portion 12 of the fastener on the thumb 10 will engage the portion of the fastener loops 11 extending over the top edge of the mitt finger portion, whereby the shaft 14 may be tightly gripped.

Figure 7:
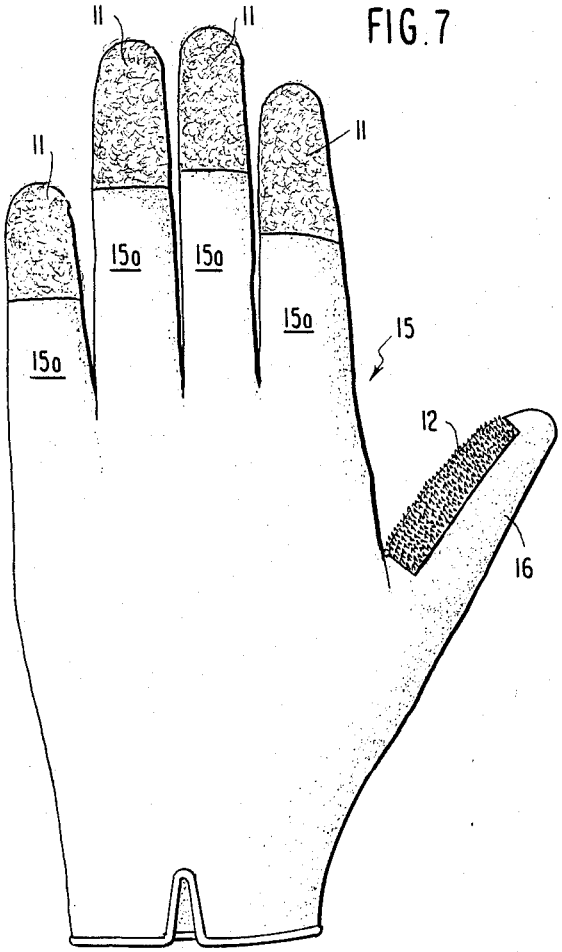
FIG. 7 is a rear elevational view of a glove having the loop portion of the fastener on the back surface of each finger portion of the glove, and the hook portion on the thumb portion of the glove.
Figure 8:
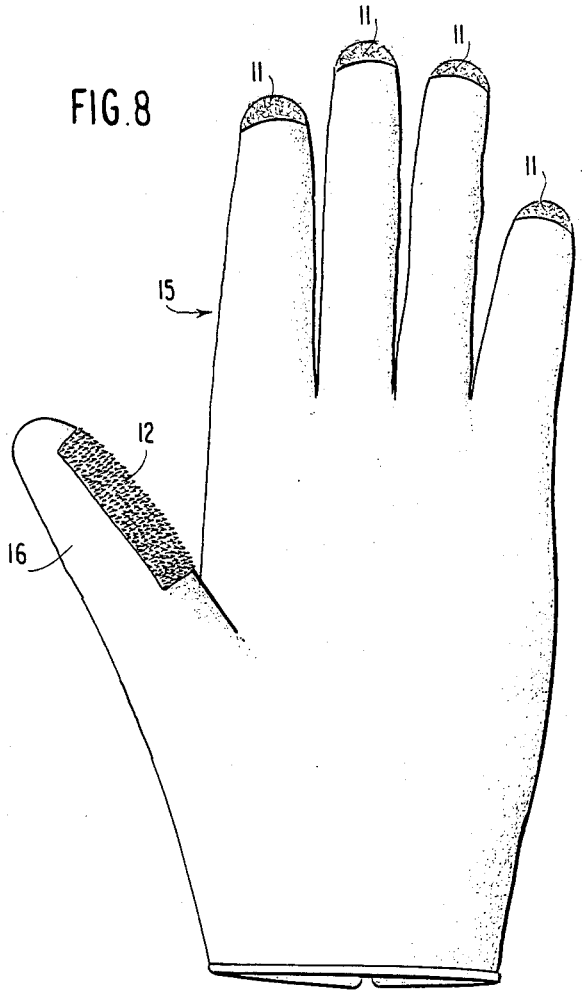
FIG. 8 is a front elevational view of the glove illustrated in FIG. 7 showing the loop portion of the fastener extending slightly over the finger tip portions of the glove.

While the inventive concept of the present invention has been described in connection with mittens, FIGS. 7 and 8 show a glove 15 having the loop portion 11 of the fastener secured to the back surface of each finger portion 15*a* and the hook portion 12 of the fastener secured to the thumb 16 of the glove and facing the index finger. As in the mitten embodiment, the loop portions 11 on the back of the glove extend from the finger tips to a position corresponding to the next proximate finger joints, and, as shown in FIG. 8, the loop portions 11 extend slightly over the top edges on the front or palm side of the glove fingers.

From the above description, it will be readily apparent by those skilled in the art that the mitten and glove of the present invention provides an improved hand covering to facilitate the gripping of various objects having different diameters.

The gloves and mittens of the invention allow the wearer to acquire and maintain a firm grip on any object that can be grasped by or held in the hand. Pressure from the thumb pressing the hook portion 12 on the thumb portion 10 or 16 into mating with the loop or pile portions 11 on the back surface 9*a* and 15*a*, and/or the tips of the finger portions 9 and 15*a*, respectively, keep the fingers stationary, thus retaining the wearer's grip on the object with reduced physical strain. The engagement of the back portions with the loop or pile portion of the fastener locks the thumb portion of the mitt or glove in firm engagement over the top of the back portion of the mitt or glove, thus locking one portion of the glove or mitt with another portion of the same glove or mitt to maintain the hand in the gripping position. The locking engagement can be released by opening the hand with sufficient force to overcome the connection of the VELCRO® fastener portions on the mitt or glove.

In sports applications, such as in weight lifting, it has been noted that the user is able to lift and hold more weight than is possible with the bare hand or with other types of gloves and mittens, and is able to maintain a grip on the bar for greater periods of time.

The gloves and mittens of the invention allow the handicapped and/or elderly to more easily grasp, lift and control objects that would normally be impossible or very difficult for them to grasp, lift or control. For example, a handicapped or elderly person with a weak hand grip can more easily and more firmly grip the bar of a walker, and thus more easily manipulate and control the walker, because once their gloved or mittened hands encircle the handbar of the walker the VELCRO® portions on the thumb and back of the finger areas lock together thus locking their hands around the bar and maintain their grip with little effort. This makes them feel more secure because of the firmer grip on the bar, thus allowing them to concentrate on other things, such as manipulating the walker without fear of loosing their grip on it, and permitting the to become more mobile.

It is to be understood that the hook portions and loop or pile portions may be interchanged if desired. When gripping a rod or shaft, the thumb usually overlies the back of only the index finger, middle finger and ring finger, and rarely overlies the back of the little finger. With this in mind, the loop or pile portion 11 on the mitt and on the glove could be omitted from the portion of back surfaces 9*a* and 15*a*, respectively, in the areas on the back of the little finger, and be provided at least in the areas on the backs of at least the index finger and the middle finger. However, since different people grip differently shaped objects with their fingers in different positions, and since certain people may have abnormalities in their index and middle fingers, requiring them to grip objects with the thumb overlying the backs of the ring finger and little finger, in order to render the mitts and gloves of the invention universally usable it is preferred to provide the fastener portions 11 on the back and tips of all the finger portions 15*a* of the glove, and on the back surface 9*a* in the area spanning all the fingers of the mitt, as shown in the drawings.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A hand covering to facilitate gripping objects of different diameters, said covering including a finger portion and a thumb portion, and cooperating, releasable fastener means secured to the thumb portion and to the back surface of the finger portion, whereby when gripping an object, the thumb portion overlaps the back surface of the finger portion, to thereby engage the fastener means between the finger portion and thumb portion.

2. A hand covering according to claim 1, wherein the fastener means comprises loop portions on the finger portion and hook portions on the thumb portion.

3. A hand covering according to claim 2, wherein the hand covering is a mitten.

4. A hand covering according to claim 2, wherein the hand covering is a glove.

5. A hand covering according to claim 3, wherein the 1 loop portion of the fastener extends across the back of the mitten and configured to correspond to the area between the finger tips of the wearer and the next proximate finger joints.

6. A hand covering according to claim 5, wherein the loop portion of the fastener extends slightly over the top edge of the front side of the mitten.

7. A hand covering according to claim 6, wherein the hook portion on the thumb portion faces the index finger portion of the mitten.

8. A hand covering according to claim 4, wherein the loop portion of the fastener extends across the backs of each finger portion of the glove.

9. A hand covering according to claim 8, wherein the loop portions are configured to correspond to the area between the finger tips of the wearer and the next proximate finger

10. A hand covering according to claim 9, wherein the loop portions extend slightly over the top edges on the front side of the glove fingers.

11. A hand covering according to claim 10, wherein the hook portion of the fastener is secured to the thumb portion of the glove facing the index finger.

12. A hand covering according to claim 1, wherein the hand covering is a glove, said releasable fastener means on the thumb portion is positioned to face the index finger portion of the finger portion of the glove.

13. A hand covering according to claim 1, wherein the releasable fastener means on the thumb portion faces the index finger portion of the finger portion of the hand covering.

14. A hand covering according to claim 1, in which said releasable fastener means secured to the back surface of the finger portion extends across the back surface corresponding to the area of at least the index and middle fingers.

15. A hand covering according to claim 1, wherein the releasable fastener means on the thumb portion and finger portion comprise mating hook portions and loop or pile portions.

* * * * *